US007237411B2

(12) United States Patent
Pantke et al.

(10) Patent No.: US 7,237,411 B2
(45) Date of Patent: Jul. 3, 2007

(54) OPERATING DEVICE FOR A MOTOR VEHICLE DOOR LOCK

(75) Inventors: Reinhard Pantke, Bad Liebenzell (DE); Stefan Adams, Leonberg (DE)

(73) Assignee: Dr. Ing. h.c.F. Porsche Aktiengesellschaft, Stuttgart (DE)

( * ) Notice: Subject to any disclaimer, the term of this patent is extended or adjusted under 35 U.S.C. 154(b) by 12 days.

(21) Appl. No.: 11/079,076

(22) Filed: Mar. 15, 2005

(65) Prior Publication Data

US 2005/0210936 A1 Sep. 29, 2005

(30) Foreign Application Priority Data

Mar. 27, 2004 (DE) ..... 10 2004 015 136

(51) Int. Cl.
*E05B 3/00* (2006.01)

(52) U.S. Cl. ..... 70/208; 70/210; 292/336.3; 292/352; 292/DIG. 31; 292/DIG. 53; 16/412

(58) Field of Classification Search ..... 292/336.3, 292/351, 352, DIG. 53, 348, 356, DIG. 31, 292/DIG. 64, DIG. 63, 357; 16/412; 70/208, 70/210, 451, 466, DIG. 31
See application file for complete search history.

(56) References Cited

U.S. PATENT DOCUMENTS 529,887 A * 11/1894 Wardwell ..... 292/351
4,818,003 A * 4/1989 Seko et al. ..... 292/336.3
4,838,590 A 6/1989 Isomura
5,340,174 A * 8/1994 Bender et al. ..... 292/336.3
5,961,165 A 10/1999 Aizawa et al.
6,059,329 A * 5/2000 Spitzley ..... 292/336.3
6,073,397 A * 6/2000 Tanimoto et al. ..... 49/460
6,415,636 B1 * 7/2002 Fukumoto et al. ..... 70/208
6,543,090 B2 * 4/2003 Muneta ..... 16/412
6,550,103 B2 * 4/2003 Koops et al. ..... 16/412

FOREIGN PATENT DOCUMENTS

| | | |
|---|---|---|
| DE | 37 32 674 A1 | 5/1988 |
| DE | 198 09 449 A1 | 9/1999 |
| DE | 199 48 677 A1 | 6/2000 |
| FR | 2 592 909 | 7/1987 |
| JP | 1-162564 | 6/1989 |
| JP | 6-286467 | 11/1994 |

OTHER PUBLICATIONS

European Search Report and Translation of Pertinent Portions Thereof.

* cited by examiner

*Primary Examiner*—Lloyd A. Gall
(74) *Attorney, Agent, or Firm*—Crowell & Moring LLP

(57) ABSTRACT

An operating device for a motor vehicle lock having a door lock actuator includes a grip plate and a grip with one bearing arm that extends through the grip plate and is swivellably linked to a rear side of the grip plate via a bearing block by way of a plug-type shaft. A securing element for the plug-type shaft secures the latter against sliding-out. A protective covering, which at least partially covers the rear side of the grip plate, has at least one extension that serves as a securing element and is situated next to an end of the plug-type shaft.

7 Claims, 3 Drawing Sheets

OPERATING DEVICE FOR A MOTOR VEHICLE DOOR LOCK

BACKGROUND AND SUMMARY OF THE INVENTION

This application claims the priority of German patent document 10 2004 015 136.9, filed Mar. 27, 2004, the disclosure of which is expressly incorporated by reference herein.

The invention is directed to an operating device for a motor vehicle door lock.

U.S. Pat. No. 5,961,165 discloses an operating device of the above-mentioned type for a motor vehicle door lock on a vehicle tailgate. The operating device includes a grip plate which can be connected with the skin of the door. On the rear side of the grip plate, at least one bearing block is provided in which at least one bearing arm of a grip is swivellably linked via a plug-type shaft. The bearing arm penetrates the grip plate. Furthermore, the operating device has a securing element for the plug-type shaft which is formed by a deformed plug-type shaft head on the plug-type shaft itself.

German Patent Document DE 37 32 674 A1 discloses an operating device for a door lock in which a grip is disposed on the rear side of a grip plate. For this purpose, a plug-type shaft is provided which has a notch on its lateral surface. An elastically constructed claw that originates from the grip plate engages with the notch.

In addition, German Patent Document DE 198 09 449 A1 also relates to an operating device for a door lock, which has a grip plate with a slide-in shaft arranged on its rear side. A grip reaches through the grip plate and is disposed swivellably about a plug-type shaft in a bearing block. The bearing block, the grip and the plug-type shaft accommodated in the bearing block are inserted as a prefabricated unit into the slide-in shaft. By means of the wall of the slide-in shaft, the plug-type shaft is protected against a sliding-out.

One object of the invention is to provide an operating device of the initially mentioned type whose mounting is simplified.

Another object of the invention is to provide such an operating device which also affords optimized operational reliability.

These and other objects and advantages are achieved by the operating device according to the invention, in which the protective covering is mounted on the rear side, so that the plug-type shaft is secured against sliding-out. As a result, specially machined plug-type shafts with a widened head or the like are not necessary. In addition to securing the plug-type shaft, the protective covering has a safety function, because objects detaching inside the vehicle door (for example, in the event of a collision) are kept away from the rear side of the grip plate, and operational reliability of the operating device is optimized. For example, in the event of a collision, a glass pane arranged in the vehicle door may break, but the protective covering prevents pieces of glass from blocking the (particularly mechanical) door lock actuator. The operating device is preferably used as an exterior door grip operating device.

In one embodiment of the invention, the plug-type shaft is secured in two directions against sliding out of the bearing block. Moreover, in a preferred embodiment, the securing element has a roof-shaped construction which prevents penetration of foreign bodies in the area of the plug-type shaft.

According to still another embodiment of the invention, the grip-through opening for the door lock actuator is formed in the approximately vertically extending shell bottom, reducing the danger of a penetration of a foreign body.

Other objects, advantages and novel features of the present invention will become apparent from the following detailed description of the invention when considered in conjunction with the accompanying drawings.

DETAILED DESCRIPTION OF THE INVENTION

Figure 1:
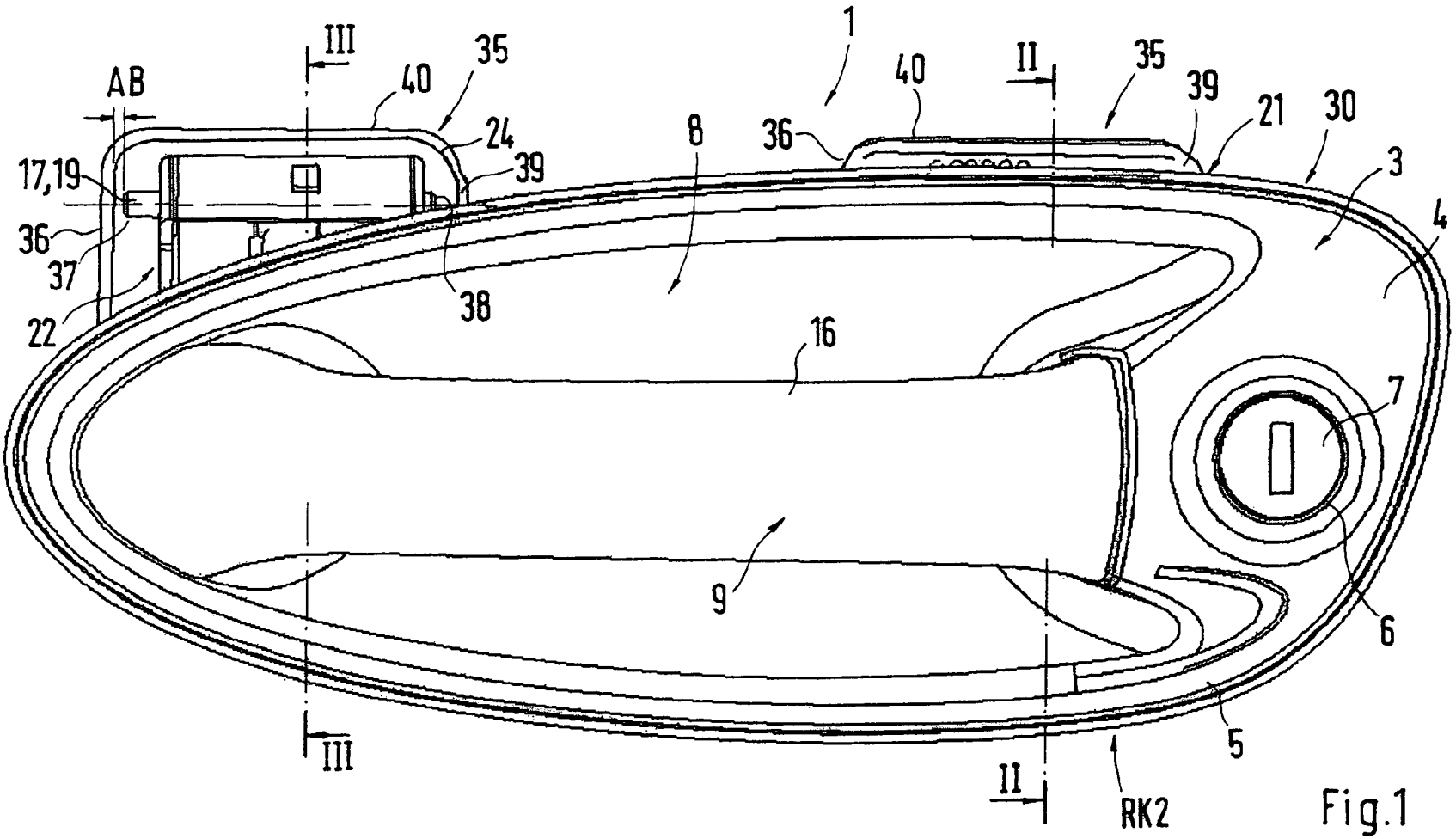
FIG. 1 is a view of an operating device for a motor vehicle door lock.
Figure 2:
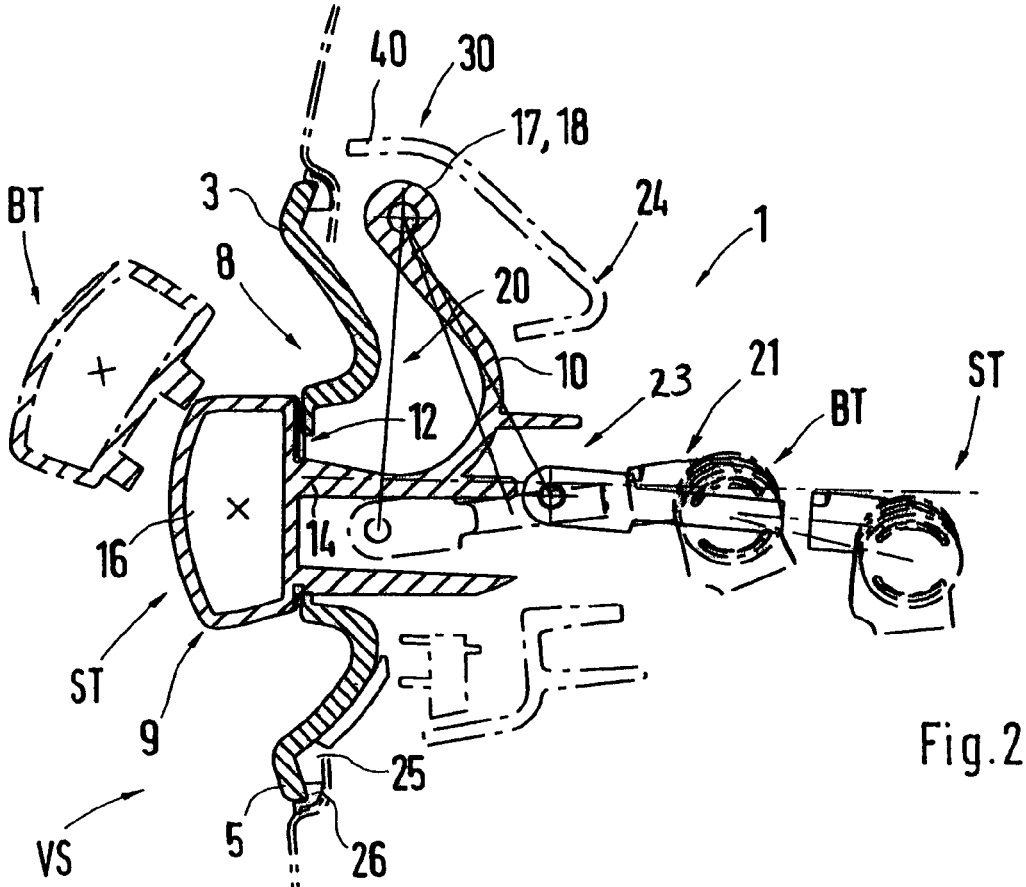
FIGS. 2 and 3 are sectional views of the operating device according to FIG. 1 along Lines II—II and III—III respectively.
Figure 3:
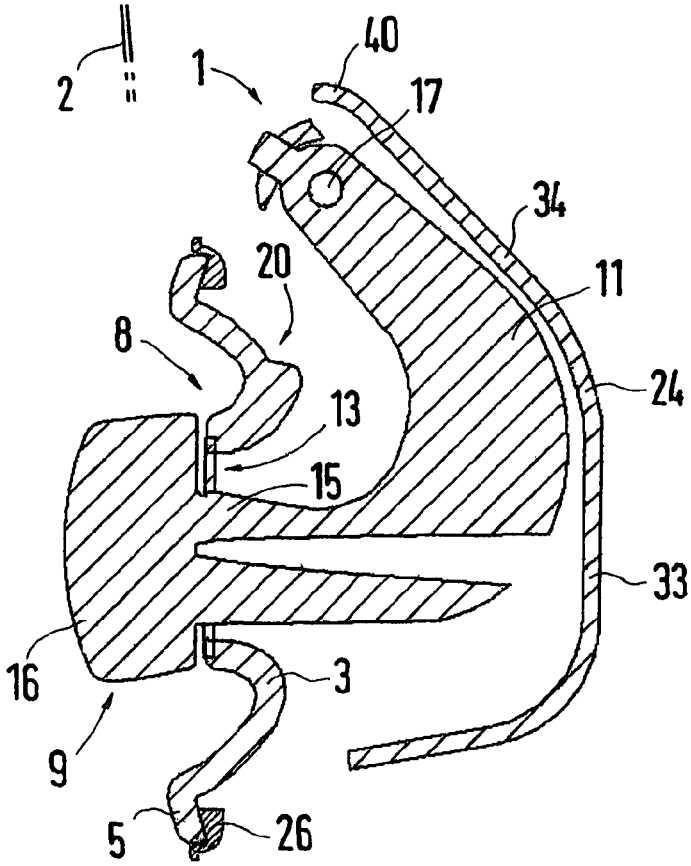

FIGS. 1 to 3 illustrate an operating device 1 for a door lock (not shown) of a motor vehicle door. An outside door panel 2 of the motor vehicle door (hereinafter referred to simply as a "door") is shown. In the illustrated embodiment, it is therefore assumed that the operating device is used as an exterior door operating device; however, use as an interior door operating device is also possible.

As shown in FIG. 1, the operating device 1 has a grip plate 3, which is inserted into the outside door panel 2 (FIG. 2) and comprises an approximately planar plate section 4 with a surrounding edge 5. A cylinder opening 6 is formed in the plate section 4, into which a lock cylinder 7 is inserted. The surrounding edge 5 and the plate section 4 bound a grip recess 8 of the grip plate 3, which is set back, relative to the outside door panel 2, so that it is possible to reach in between a grip 9 and the grip recess 8 for moving the grip 9. The grip 9 has at least one (however, preferably two) bearing arms 10 and 11 respectively (FIGS. 2 and 3) which extend through the grip plate 3, particularly in the grip recess 8, in passage openings 12 and 13 respectively from the direction of the front side VS of the grip plate 3.

At one of their ends 14, 15, the bearing arms 10, 11 are fixedly connected by a grip section 16 of the holding grip 9. The grip section 16 is situated on the outside and arranged facing the grip recess 8. (Alternatively, the grip section 16 and the bearing arms 10, 11 may be constructed in one piece.) The other end of each of the bearing arms 10, 11 is connected by way of a plug-type shaft 17 constructed as a pin (which may be constructed in two parts with shaft sections 18, 19 as shown), in one of the bearing blocks 21 and 22 respectively arranged on the rear side 20 of the grip plate 3, so that the grip 9 for operating the door lock can be swiveled from an inoperative position ST into an operative position BT, whereby a door lock actuator 23 (FIG. 2), which is linked to the grip 9, is moved and thereby unlocks the door lock.

A protective covering 24 (FIGS. 1–3) which is disposed at a distance from the rear side 20 of the grip plate 3 and may be fastened to the grip plate 3 or optionally to the door, covers the rear side 20 and the bearing arms 10 and 11 respectively at least partially above the bearing blocks 21 and 22 respectively. The protective covering 24 is preferably fastened to the grip plate 3, so that the operating device 1 can be inserted as a prefabricated module in the opening 25 of the skin 2 of the door, with the edge 5 of the grip plate 3 coming to rest on the outside panel 2 (optionally by means of a seal 26).

The protective covering 24 has a shell-shaped construction at least in sections, with a covering section 27 assigned to the plane plate section 4 of the grip plate 3, a shell section 28 assigned to the grip recess 8 and an edge section 29 assigned to the edge 5, the latter surrounding the grip recess 8, and the edge section 29 surrounding the shell section 28. An edge contour RK1 of the protective covering 24 is obtained which follows the approximately oval edge contour RK2 of the grip plate, so that the edge section 29 (and optionally the covering section 27) can rest on the assigned edge 5 (and optionally the plate section 4). In this manner, an essentially closed housing 30 is obtained, consisting of the protective covering 24 and the grip plate 3.

In addition, a second cylinder opening 31 for the lock cylinder 7, which is aligned with the first cylinder opening 6, and a reach-through opening 32 for the door lock actuator 21 are provided in the protective covering 24. In this case, the reach-through opening 32 may be situated in the shell section 28, particularly in a shell bottom 33 of the shell section 28. A surrounding shell wall 34 originates from the shell bottom 33 and changes into the edge section 29 and the covering section 27. The shell bottom 33 and the edge section 29 extend at least partially approximately parallel to the outside door panel 2; and the shell wall 34 (situated between the edge section 29 and the shell bottom 33) encloses an angle thereto.

Figure 4:
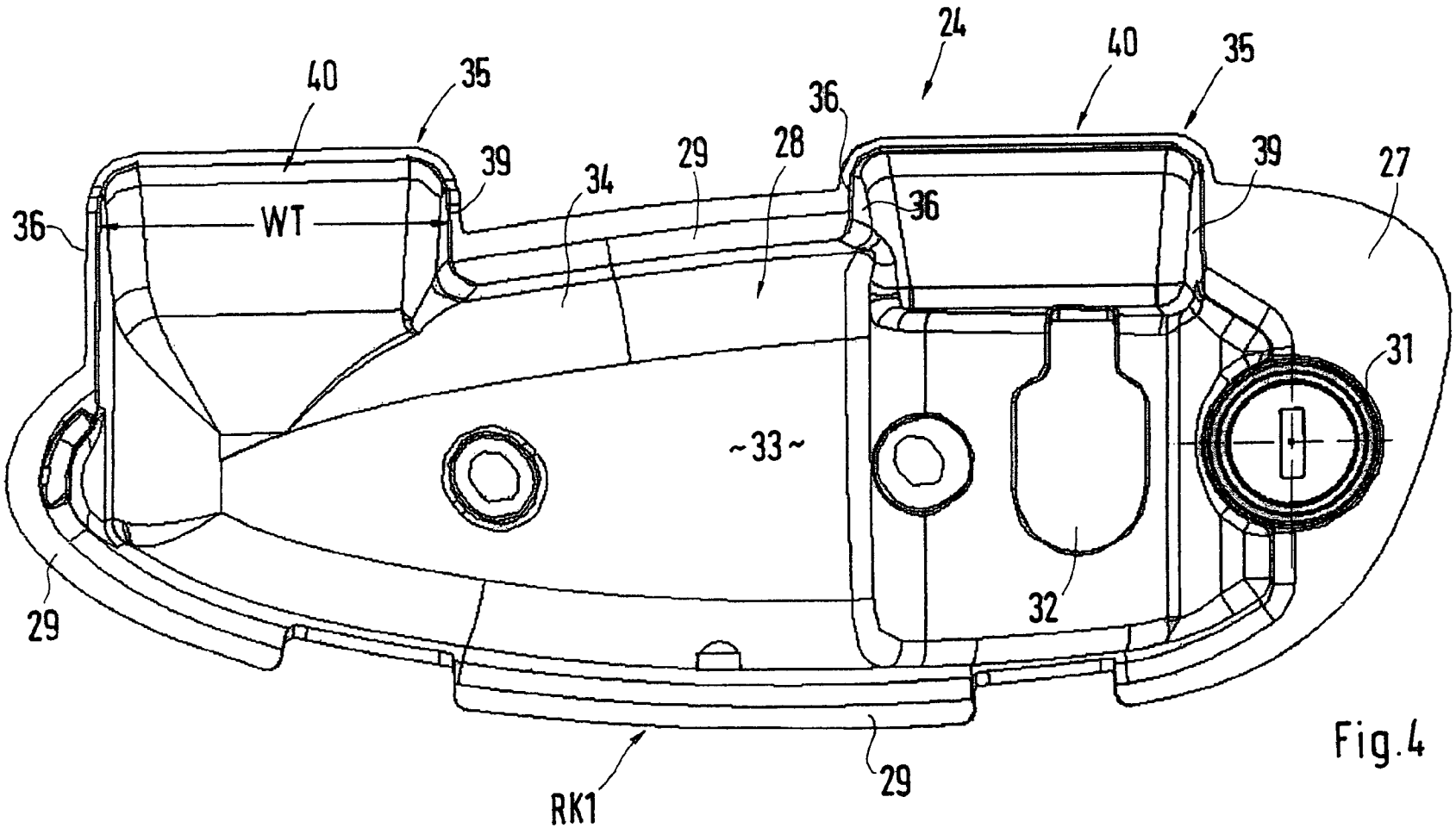
FIG. 4 is a top view of a protective covering for the operating device.

The protective covering 24 has at least one securing element 35 which prevents the plug-type shaft 17 from sliding out of the respective bearing blocks 21 and 22 and the respective bearing arm 10 and 11. For this purpose, the securing element 35 has at least one extension 36 which starts out from the protective covering 24 (for example, from its edge section 29 in particular), and comes to rest next to a free end 37, 38 of the plug-type shaft 17, preferably at a narrow distance AB. Preferably, an extension 36, 39 is provided for each end 37, 38 of the plug-type shaft 17. As shown in FIG. 4, the extensions 36, 39 receive the plug-type shaft 17 between one another and, corresponding to the length of the plug-type shaft 17, have a distance WT between them which is adapted thereto. The extensions 36 and 39 project beyond the edge contour RK1 and RK2 respectively since the bearing blocks 21 and/or 22 extend beyond the edge contour RK1 and RK2 respectively; therefore, at least one section of the plug-type shaft 17 is situated outside the edge contour RK1 and RK2 respectively. The extensions 36, 39 are connected to each other by a roof section 40, so that the securing element 35 has a design similar to a dormer window. Because the roof section 40 extends close to the edge 5, penetration of objects or foreign bodies into the housing 30 is prevented in most cases.

If, as mentioned above, a two-part plug-type shaft 17 with the two shaft sections 18 and 19 is used for the swivellable bearing of the grip 9 on the grip plate 3, two securing elements 35 for the two shaft sections 18 and 19 are provided, which securing elements 35 have an essentially identical construction. The protective covering 24 with the securing element(s) is produced, for example, in one piece, preferably as a plastic molding.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An operating device for a motor vehicle lock, having a door lock actuator, a grip plate, a grip with at least one bearing arm which extends through the grip plate and is swivellably linked to a rear side of the grip plate by a bearing block and a plug-type shaft, and having a securing element for the plug-type shaft which secures the plug-type shaft against sliding-out, wherein:

the operating device also has a protective covering which covers a rear side of the grip plate; and the protective covering has at least one extending portion which forms the securing element, and which is situated adjacent an end of the plug-type shaft;

the protective covering is formed, at least in sections, as a shell;

the protective covering has an edge contour that follows an edge contour of the grip plate;

the securing element has two extensions which are disposed at a distance from each other, which distance is greater than or equal to a length of the plug-type shaft;

the securing element is formed in a roof shape, with the two extensions and a roof section;

the securing element projects at least partially beyond an edge contour of the protective covering; and the shell which constitutes the protective covering has a shell bottom and a shell wall originating from the latter, and the at least one extending portion starts out from an edge section surrounding the shell.

2. The operating device according to claim 1, wherein the at least one extension is situated at a narrow distance from an end of the plug-type shaft.

3. The operating device according to claim 1, wherein:

the grip has two bearing arms which extend through the grip plate;

two bearing blocks are correspondingly arranged on a rear side of the grip plate; and the bearing arms are linked to the bearing blocks by way of the plug-type shaft.

4. The operating device according to claim 3, wherein the plug-type shaft comprises at least two sections.

5. The operating device according to claim 4, wherein a securing element is provided for each shaft section.

6. The operating device according to claim 1, wherein the protective covering is made in a single piece comprising a plastic molding.

7. The operating device according to claim 1, wherein:

and a reach-through opening for the door lock actuator is made in the shell bottom, which door lock actuator can be connected with the grip on the one side, and with the door lock on another side.

* * * * *